United States Patent [19]

Minden et al.

[11] 4,109,135

[45] Aug. 22, 1978

[54] HIGH EFFICIENCY FUSER ROLL ASSEMBLY FOR XEROGRAPHIC MATERIAL

[75] Inventors: Henry Thomas Minden, Concord; Richard W. Premo, Shrewsbury, both of Mass.

[73] Assignee: Sperry Rand Corporation, New York, N.Y.

[21] Appl. No.: 790,505

[22] Filed: Apr. 25, 1977

[51] Int. Cl.[2] ..... H05B 1/00

[52] U.S. Cl. ..... 219/216; 219/469; 432/60

[58] Field of Search ..... 219/216, 388, 469–471; 355/380; 432/60, 228; 100/93 RP; 29/130, 132

[56] References Cited

U.S. PATENT DOCUMENTS

| | | | |
|---|---|---|---|
| 2,679,572 | 5/1954 | Workman | 219/469 |
| 3,239,652 | 3/1966 | Price | 219/469 |
| 3,310,655 | 3/1967 | Hager, Jr. | 219/470 |
| 3,399,292 | 8/1968 | Boldridge, Jr. | 219/469 |
| 3,884,623 | 5/1975 | Slack | 219/469 |
| 3,937,919 | 2/1976 | Clerx et al. | 219/469 X |

*Primary Examiner*—C. L. Albritton

*Attorney, Agent, or Firm*—Howard P. Terry

[57] ABSTRACT

A high efficiency fuser and pressure roll system for fixing xerographic toner particles to a carrier medium such as paper is presented having a helical resistance coil bonded at the active cylindrical surface of the fuser roll; the surface located heater is thermally isolated from the shaft mechanism supporting the fuser roll. Quick heating of the surface is achieved, along with diminished heat loss by heat conduction into the shaft and associated parts of the copier. The heater being integral with the fuser roll, heat is transferred directly and efficiently from the heater to the toner material.

4 Claims, 4 Drawing Figures

HIGH EFFICIENCY FUSER ROLL ASSEMBLY FOR XEROGRAPHIC MATERIAL

BACKGROUND OF THE INVENTION

1. Field of the Invention

The invention generally relates to the field of multiple printing or reproduction apparatus and more particularly is concerned with reproduction apparatus in which an electroscopic toner powder image is heated to an extent sufficient to fuse the powder image onto a web or sheet of carrier material as it passes through a nip formed between a conductively heated fusing roller and a cooperating back-up pressure roller.

2. Description of the Prior Art

In one form of prior art apparatus for fusing toner powder images to a carrier medium, the medium is fed, after the formation of the toner image, through a separate fuser unit before it passes through cooperating exit rollers. The fuser consists of a parallel array of resistance heater wires supported from the copier frame in a heat radiating plane just above the plane of the powder image. Arrangements of this kind are discussed, for example, in the R. F. Pichierri U.S. Pat. No. 3,834,805, issued Sept. 10, 1974 for a "Xerographic Copier with Asynchronous Copy Feed" and assigned to Sperry Rand Corporation.

While the Pichierri apparatus has enjoyed successful use and affords a conveniently low warm-up time for the reproducer, the heater wires, to be relatively efficient, are located close to the plane of the paper or other carrier medium. In the event the paper jams, there is a serious possibility of contact between a hot fuser wire and the paper, even through the hot wires are partially shielded, and fire may result or, at least, there will be damage to the medium.

In a second form of prior apparatus for fusing toner powder images to a carrier medium, the medium is fed, after the formation of the toner image, through cooperating rolls, at least one of the rolls being heated by a non-rotating infra-red radiator contained in a cylindrical cavity within the heated roll along its axis of rotation. The radiating device is normally a high power lineal quartz heat lamp or tungsten filament lamp, relatively short-lived and relatively inefficient because of its high operating temperature. Due, among other factors, to its axial disposition, transfer of heat to the active cylindrical surface of the fusing roll is entirely by radiation and is therefore inefficient and power consumption is large. Such fuser rolls also have large thermal masses and require an undesirably long warm-up time after operating power is first turned on. Thus, most electrographic plain paper copiers must be left on continuously, even if use is intermittant, with consequent added costs. Heat loss from the fusing roller to other parts of the apparatus is a further disadvantage of prior art roll fuser systems.

SUMMARY OF THE INVENTION

The present invention relates to apparatus for making multiple copies of printed or other matter by xerographic methods, usually on a plain paper carrier medium. The invention is particularly concerned with reproduction apparatus including cooperating toner fuser and pressure roll elements for fixing xerographic particles to a carrier medium. The fuser roll is equipped with a helical resistance tape for forming a heater coil disposed at the active cylindrical surface of the fuser roll. The surface heater is so disposed as to provide efficient and direct conductive heat transfer to the active fuser surface, but is thermally isolated from the mechanism supporting the fuser roll. Radiative heating and its attendent problems are avoided. In this manner, quick heating of the active fuser surface is afforded, along with reduced heat loss by thermal conduction into the shaft support mechanism. The operating temperature of the heater is reduced and lower total operating power is required.

DESCRIPTION OF THE PREFERRED EMBODIMENTS

The embodiments of the invention as illustrated in FIGS. 1 through 4 find application, for example, in an automatic xerographic printer or reproduction machine of the type illustrated in the aforementioned Pichierri U.S. Pat. No. 3,834,805. Such machines normally include several xerographic processing stations, beginning with a charging station where a uniform electrostatic charge is deposited on a photoconductive surface. The next station is an exposure station at which a light image is projected onto the photoconductor surface for forming the latent electrostatic image to be reproduced. Following the exposure station is a development station at which developer or toner particles are dispersed over the latent image and, adhering to the charged portions of the latent image, they form a corresponding powder image. At a transfer station, the powder image is electrostatically transferred intact to a web or sheet of a carrier material such as plain paper which is then passed through a heated fusing system so that the powder image becomes permanently bonded to the surface of the medium. The photoconductor surface is finally passed through a cleaning and illumination station for the removal of all residual toner and charges from the surface so that it may continue to repeat its operational cycle.

Figure 1:
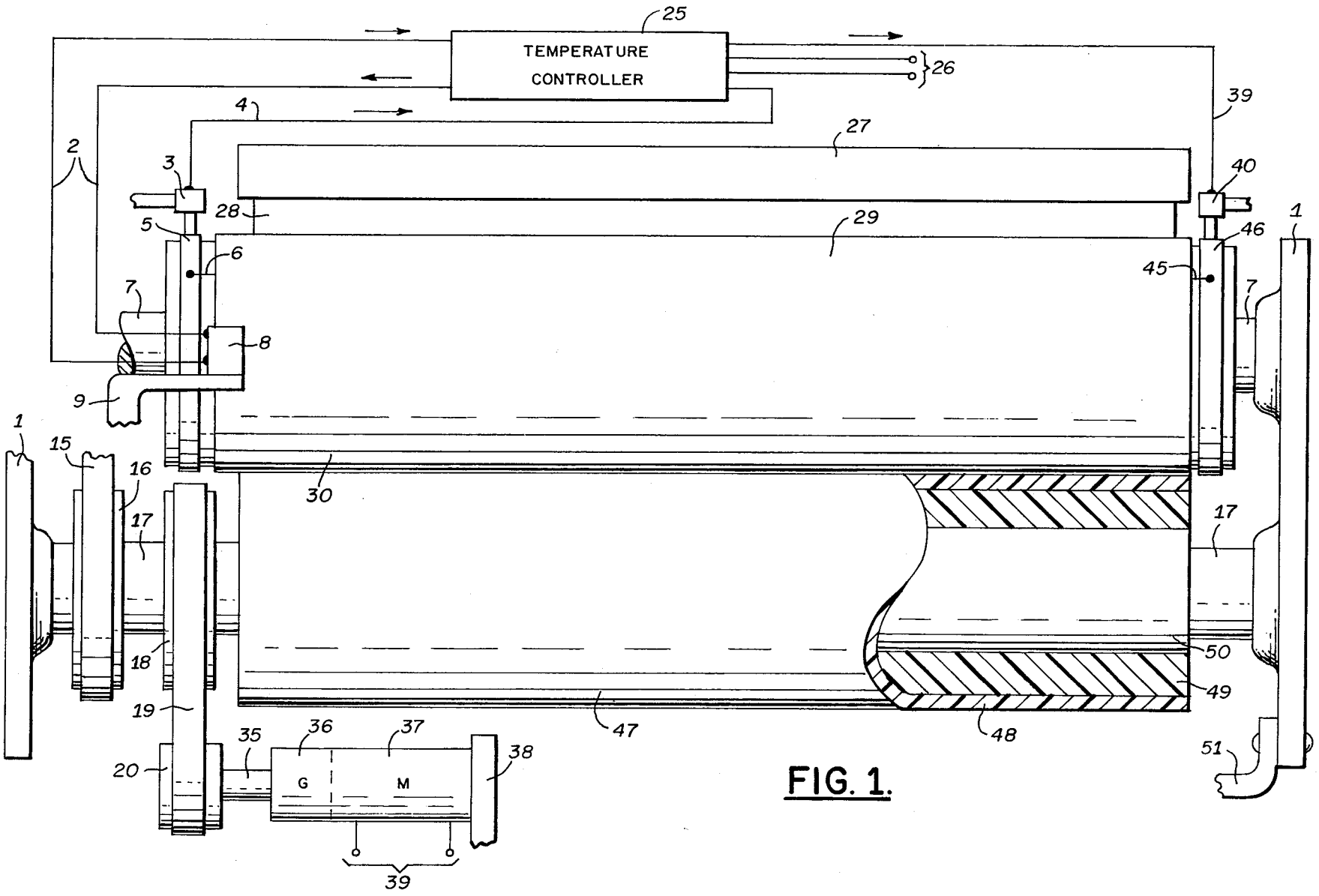
FIG. 1 is an elevation view, partly in cross-section, of a fuser-pressure roll assembly according to the present invention.

Referring particularly to FIG. 1, there is shown a heated pressure toner-fusing system which includes a heated fuser roll 29 and a cooperating back-up pressure roll 47. Details of the heated fuser roll 29 according to the invention will be further discussed in connection with FIGS. 2, 3, and 4. In general, the heated toner-fusing system performs the function of heating the powder image after its electrostatic transfer to the surface of the web or sheet so that the powder fuses and is permanently bonded to the medium upon cooling.

In FIG. 1, the pressure toner-fusing arrangement is supported in a casing 1, which may be common to the remainder of the apparatus. The heated fuser roll 29 is formed on a shaft 7, journalled at its ends in suitable bearings with respect to casing 1. Likewise, pressure roll 47 is formed on a shaft 17 journalled at its ends in suitable bearings with respect to casing 1. By way of example, pressure roll 47 may be driven when power is supplied to terminals 39 by a motor 37 mounted on a bracket 38 supported within casing 1. Motor 37 is equipped with speed-reducing gearing 36, if desired, for driving shaft 35 and pulley 20. The pulley 20 and belt 19 cooperate with a pulley 18 mounted on shaft 17 for driving it in a predetermined direction. Rolls 29 and 47 are during operation under pressure contact, so that rotation of pressure roll 47 necessarily causes fuser roll 29 to rotate in the opposite sense. If desired, fuser roll 29 as well as other moving elements of the apparatus may additionally be rotated by virtue of pulley 16, belt 15, and a cooperating pulley (not shown) fixed on shaft 7. Since the cooperating rolls 29 and 47 are disposed so that there is pressure between them, the flexible material forming outer layer 48 of back-up pressure roll 47 is distorted, forming a nip of finite width. A conventional mechanism may be provided for separating rolls 29, 47 when not in actual use.

The fuser roll 29 has a specially and directly heated surface, as will be seen, that is heated by an electrical heating current. Controlled heat is applied to provide the proper roll surface temperature. For this purpose, a conventional temperature controller 25 which operates at the desired selected temperature is coupled to a source of power (not shown) at terminals 26. A thermostat 8, which may be a thermistor or other non-contacting thermal sensor is provided close to the outer surface of the heated fuser roll 29, being supported from bracket 9. Thus, a regulating electrical signal is conveyed via leads to 2 to controller 25. The regulated output current of controller 25 is passed by leads 4 and 39 to the respective brushes 3 and 40 and to their associated slip rings 5 and 46. The leads 6 and 45 respectively connected to slip rings 5 and 46, convey the heating current to a heater within the surface of fuser roll 29, as will be further described in connection with FIGS. 2, 3, and 4. If desired, thermal sensor 8 may be disposed within fuser roll 29 but close to the outer surface thereof if additional slip ring-brush combinations are provided.

Pressure roll 47 includes an inner cylinder 49 of an elastomer such as neoprene or silicon rubber bonded to an enlarged portion 50 of cold rolled steel shaft 17 in the conventional manner. Tightly fitting over the hollow cylinder 49 is a relatively thinner hollow cylinder 48 composed of a tetrafluoroethylene resin for excluding silicone oil from damaging the material of cylinder 49. Above the heated fuser roll 29 is supported from casing 1 a reservoir 27 of silicone oil or dimethyl polysiloxane, along with a conventional wick 28 disposed in contact with the surface of heated fuser roll 29 in a generally conventional manner.

A sheet or web of a copy medium or carrier on which the final image is to be formed, bearing the toner powder image on its upper side, is brought into contact with the nip of the rolls 29, 47 with the powder image contacting the heated fuser roll 29. As the carrier sheet advances between rolls 29, 47, the toner powder image contacts the heated surface of fuser roll 29, whereby the powder image is softened or tackyfied. In this condition, it adheres to the moving web or sheet medium, being prevented from adhering to the surface of pressure roll 47 due to the nature of the material tetrafluoroethylene resin. The thin film of silicone oil applied by wick 28 to the surface of roll 29 desirably prevents adherence of the tacky toner particles to roll 29 in the usual manner.

Figure 2:
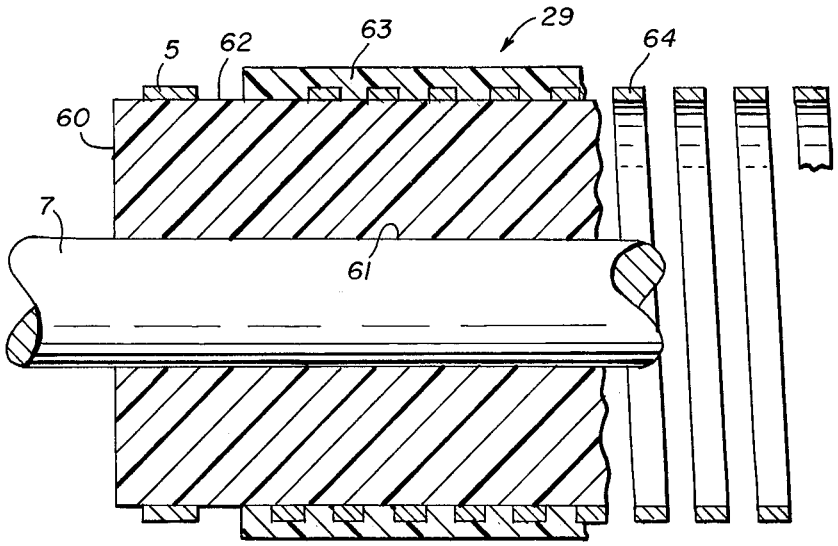
FIGS. 2, 3 and 4 are elevation views, in partial cross-section, of novel fuser rolls which may be used in the apparatus of FIG. 1.
Figure 3:
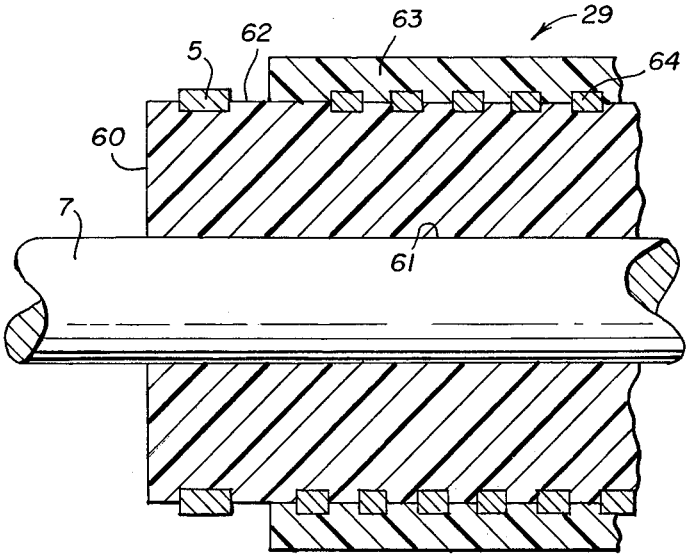

One form of the novel heat fuser roll 29 is displayed in FIG. 2, where parts common to FIG. 1 bear similar reference numerals, including slip ring 5 and shaft 7, which latter shaft may be solid or hollow. To achieve an effectively low thermal mass, thus permitting rapid heating of the active surface of the fuser roll 29, heating is substantially done only at the roll surface, and loss of heat to the shaft 7 is diminished significantly through the provision of paths having high thermal impedances. As in FIG. 2, the cold rolled steel shaft 7 has molded on or bonded to its surface 61 a hollow cylinder 60 of a thermally insulating or dielectric material such as a conventional plastic, ceramic, or polymerized material. Slip rings, such as slip ring 5, are located on surface 62 at the ends of cylinder 60. A coil or helix 64 of a nickel-chrome or other conventional heater alloy tape or wire is bonded to surface 62, its opposite ends being coupled by leads 6, 45 to the respective slip rings 5, 46, as shown in FIG. 1. Helix 64 is covered by a relatively thin, tightly fitting tube 63 of plastic material whose outer surface is the web or sheet contacting surface. The tube 63 may readily be formed of a material such as tetrafluoroethylene resin which is impervious to silicone oil, or of a similar heat-shrinkable material. In the alternative construction of FIG. 3, the fuser roll 29 has cut into its outer surface 62 a spiral groove for directly accommodating the spiral heater tape 64, a thin, tightly fitting tube 63 of a resin material such as tetrafluoroethylene resin again providing an electrically insulating cover for helix 64. The tubular structure 63 may be molded in place after the installation of helix 64. The helix 64 may be formed in or bonded within the helical groove by conventional methods. In a similar manner, slip rings 5 and 46 may be formed in appropriate indentations in the surface 62 of cylinder 60. In the arrangements of FIGS. 1 and 2, application of heat directly at the surfaces 62 by helices 64 permits the apparatus to be put quickly into operation since the temperature at the operating surface of sleeve 63 rises rapidly to the selected level. Also, a high thermal impedance path exists between helix 64 and shaft 7, an otherwise major heat loss path by thermal conduction. Thus, the temperature at the surface of sleeve 63 rises rapidly when the apparatus is first turned on, and the heating of that surface is efficient and therefore economical.

Figure 4:
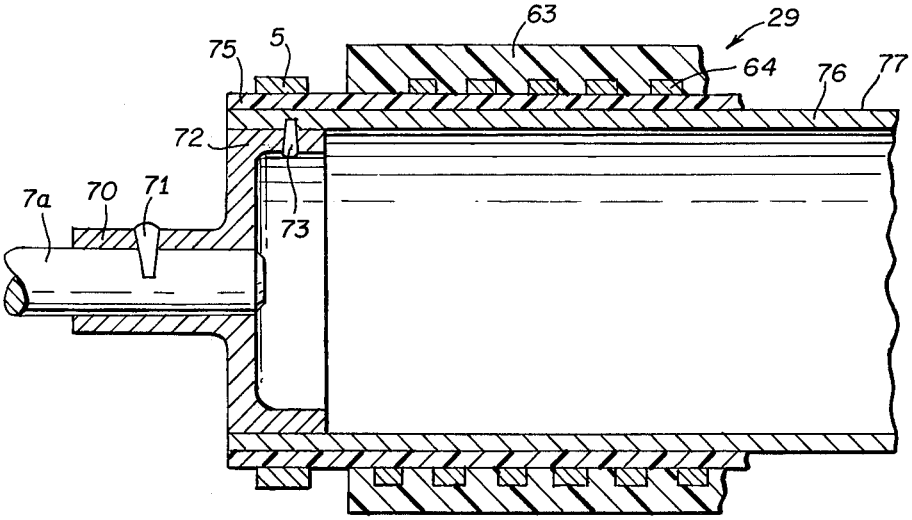

The desired low thermal mass and low heat loss characteristics are also achieved in the novel configuration illustrated in FIG. 4, wherein a hollow fuser roll 29 is mounted on separated shafts *7a* at its opposite ends. Each end of roll 29 is supported on an end cap 72 integral with a hub 70 fastened by a pin 71 to a shaft *7a*. The roll 29 utilizes a hollow metal cylinder 76 pinned to end cap 72, as at 73. End caps 72 and cylinder 76 are preferably constructed of a poor heat conductor, such as stainless steel or an appropriate plastic or ceramic, for example. For thermal isolation of the heater helix 64, a layer 75 of a plastic or ceramic material is bonded to the outer surface 77 of cylinder 76 upon which helix 64 is disposed. The electrically isolating layer 63 may be similar to layer 63 in FIGS. 2 and 3. If desired, the helix 64 may be placed in a helical surface identation in cylinder 75, as in FIG. 3.

Accordingly, it is seen that the invention provides novel heated fuser-pressure roll assemblies having low effective thermal masses and low heat loss to associated parts of a xerographic reproduction machine, thereby permitting rapid heating at the surface of the fuser roll of that surface. More efficient operation is provided by the use of direct heat conduction from the heater, integral with the roller, to the toner material, radiative transfer being avoided. In viewing the several figures, it will be understood by those skilled in the art that liberties have been taken in the selection of proportions and dimensions of various elements in the interest of providing clarity in the drawings, and that the exact proportions and dimensions illustrated would not necessarily be selected for use by those skilled in practicing the art. Those skilled in the art will also understand that the invention may be used in a wide range of applications wherein the selected operating paramters, such as the fuser roll surface temperature, roll speed, roll pressure, and such variables will depend upon the selected toner and web or sheet carrier characteristics.

While the invention has been described in its preferred embodiments, it is to be understood that the words which have been used are words of description rather than of limitation and that changes within the purview of the appended claims may be made without departing from the true scope and spirit of the invention in its broader aspects.

What is claimed is:

1. An efficient fuser roll assembly for use in a xerographic copier including:

frame means, shaft means journalled within said frame means, thermally insulating roll means disposed coaxially upon said shaft means and having cylindrical outer surface means and first and second ends, first and second slip ring means bonded in intimate relation at said cylindrical outer surface means at the respective first and second ends thereof, heater means in the form of a flat tape having a predetermined electrical resistance bonded in intimate relation at said cylindrical outer surface means and coupled between said first and second slip ring means, and a thin layer of electrically insulative tetrafluoroethylene resin enveloping said heater means and said thermally insulating roll means for forming the active fusing surface of said fuser roll assembly and providing a direct conductive heat path between said heater means and said active fusing surface.

2. Apparatus as described in claim 1 wherein said hub means and said hollow cylinder means are composed of stainless steel.

3. Apparatus as described in claim 1 wherein said hollow cylindrical electrically insulating means is composed of a plastic material.

4. An efficient fuser roll assembly for use in a xerographic copier including:

frame means, shaft means journalled within said frame means, thermally insulating roll means disposed coaxially upon said shaft means and having cylindrical outer surface means and first and second ends, first and second slip ring means bonded in intimate relation at said cylindrical outer surface means at the respective first and second ends thereof, heater means bonded in intimate relation at said cylindrical outer surface means and coupled between said first and second slip ring means, and a thin layer of electrically insulative material enveloping said heater means and said thermally insulating roll means for forming the active fusing surface of said fuser roll assembly and providing a direct conductive heat path between said heater means and said active fusing surface, said thermally insulating roll means being hollow and comprising:

first and second hub means supported by said shaft means, hollow cylinder means supported on said first and second hub means, said hub means and said hollow cylinder means having a predetermined high thermal impedance, and hollow cylindrical electrically insulating means bonded externally to said hollow cylinder means for forming said cylindrical outer surface means.

* * * * *